US009560927B2

(12) United States Patent
Krumpe

(10) Patent No.: US 9,560,927 B2
(45) Date of Patent: Feb. 7, 2017

(54) BI-FOLD HINGEHOOK METHOD AND APPARATUS

(75) Inventor: Geraint Krumpe, Chicago, IL (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 1484 days.

(21) Appl. No.: 12/889,518

(22) Filed: Sep. 24, 2010

(65) Prior Publication Data

US 2012/0074277 A1 Mar. 29, 2012

(51) Int. Cl.
*A47G 25/06* (2006.01)

(52) U.S. Cl.
CPC ..... *A47G 25/0607* (2013.01)

(58) Field of Classification Search
USPC ..... 248/490, 498, 339, 341, 322, 211, 213,248/215, 225.21, 234, 690, 691, 692, 304, 303,248/301, 306, 305, 308, 302, 289.11, 282.1,248/290.1, 291.11, 497, 100, 227.1, 294.1, 617; 16/221, 222, 235, 239, 240, 241, 267, 269, 16/355, 360, 223; 211/19.004, 106.01
See application file for complete search history.

(56) References Cited

U.S. PATENT DOCUMENTS

| | | | | |
|---|---|---|---|---|
| 69,587 | A | 10/1807 | Putnam | |
| 33,025 | A * | 8/1861 | Lattin | 24/578.12 |
| 194,083 | A | 8/1877 | Gildersleeve | |
| 223,963 | A | 1/1880 | Taylor | |
| 364,990 | A | 6/1887 | Crosby | |
| 417,959 | A | 12/1889 | Welton | |
| 419,414 | A | 1/1890 | Campbell | |
| 708,666 | A | 9/1902 | Rodriguez | |
| D38,025 | S | 5/1906 | Lattin | |
| D50,217 | S | 1/1917 | Fawcett | |
| 1,213,808 | A | 1/1917 | Page | |
| 1,651,969 | A | 12/1927 | Saxton | |
| 1,869,226 | A * | 7/1932 | Subick | 248/207 |
| 2,047,107 | A | 7/1936 | Milhime | |
| 2,131,990 | A | 10/1938 | Tisdale | |
| 2,490,994 | A | 12/1949 | Brown | |
| D159,513 | S | 8/1950 | Pease | |
| D162,864 | S | 4/1951 | Nielsen et al. | |
| 2,561,806 | A | 7/1951 | Mailland | |
| 4,721,212 | A | 1/1988 | Lowe | |
| 5,038,945 | A | 8/1991 | Melkonian | |
| 5,480,076 | A * | 1/1996 | Siegel et al. | 223/94 |
| D398,799 | S | 9/1998 | Warshawsky | |
| D421,565 | S | 3/2000 | Jones et al. | |
| 6,050,427 | A | 4/2000 | Loveland | |
| D431,912 | S | 10/2000 | Bailey | |
| 6,196,398 | B1 | 3/2001 | Lowe | |
| 6,484,363 | B1 * | 11/2002 | Chung | 16/242 |
| D608,100 | S | 1/2010 | Yoo | |

* cited by examiner

*Primary Examiner* — Jonathan Liu
(74) *Attorney, Agent, or Firm* — Carlson, Gaskey & Olds, PC

(57) ABSTRACT

A hinge hook has a pair of rotatable hooks that are mounted coaxially and side-by-side that move independently of each other.

13 Claims, 1 Drawing Sheet

BI-FOLD HINGEHOOK METHOD AND APPARATUS

TECHNICAL FIELD

This invention relates to hooks and more particularly to hooks that may hold more than one article

BACKGROUND OF THE INVENTION

There are many ways to hold more than one article from a wall. For instance, there are robe holders that have a single corbel having two hooks that rotate about separate axes disposed vertically in the corbel. Additionally some corbels have many hooks extending therefrom that do not move relative to each other. Some hooks are disposed coaxially but move separately from each and do not intersect.

SUMMARY OF THE INVENTION

According to an exemplar provided herein, a hinge hook has a pair of rotatable hooks that are mounted coaxially and side-by-side that move independently of each other.

According to an aspect of the exemplar stated above, each of the pair of hooks are mirror images of each other.

According to a further exemplar provided herein, a hinge hook has a first hook that is rotatable about an axis, and a second hook that is rotatable the same axis wherein upon rotation the first hook and the second hook come into contact with each other.

According to an exemplar provided herein a method for hanging articles includes providing a hinge hook having a pair of hooks mounted coaxially side-by-side and rotatable independently of each other, rotating the pair of hooks so that the pair of hooks are in contact side-by-side, and hanging a load from both of the hooks.

These and other features of the present invention can be best understood from the following specification and drawings, the following of which is a brief description.

DETAILED DESCRIPTION OF THE PREFERRED EMBODIMENT

Figure 1:
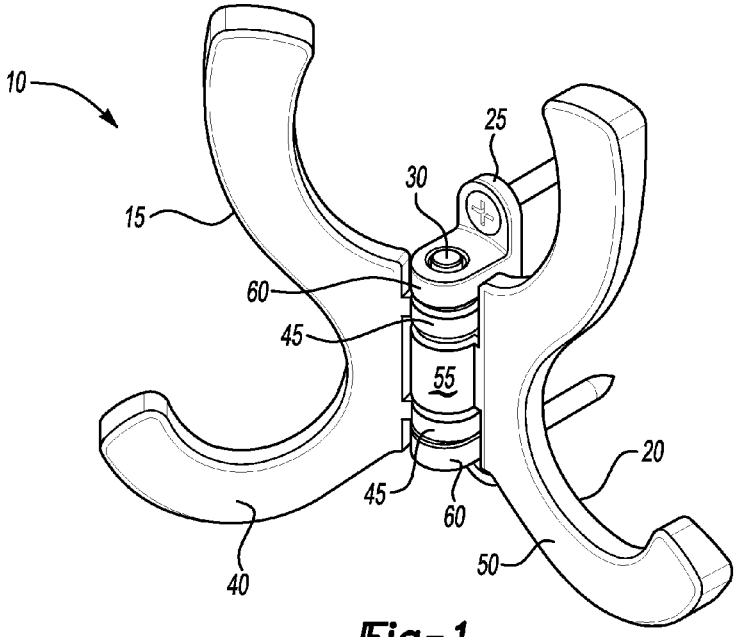
FIG. 1 shows a hinge hook that as disclosed herein.
Figure 2:
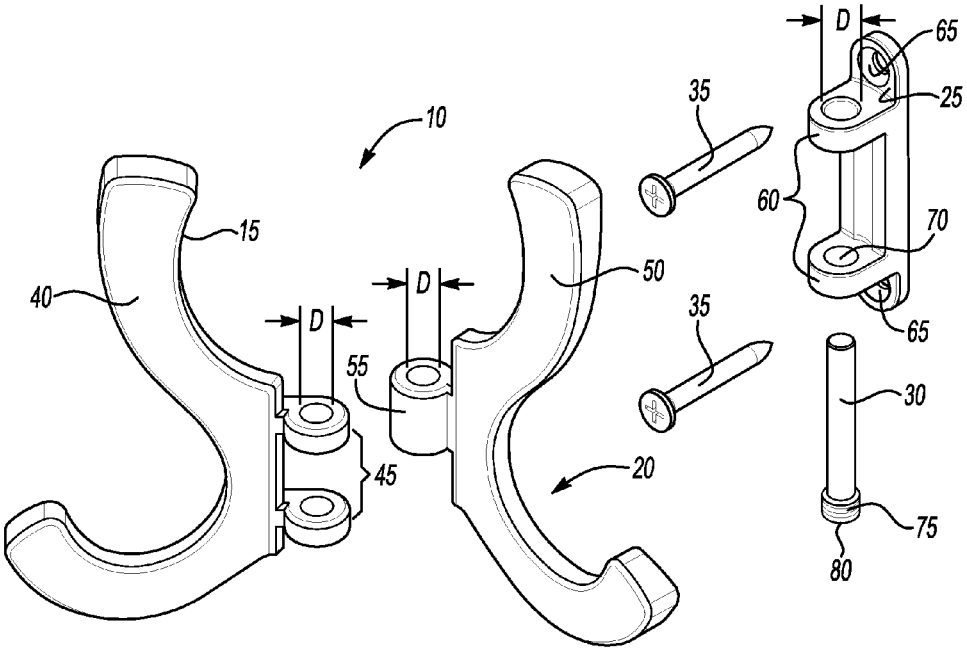
FIG. 2 shows an exploded view of the hinge hook of FIG. 1.

Referring to the drawings, a hinge hook 10 has a left side hook 15, a right side hook 20, a base 25, a hinge pin 30 and a pair of screws 35.

The left side hook 15 has a first J-shape 40 for hanging more than one article (not shown) therefrom such as clothing (not shown) and a first pair of eyelets 45 (e.g., connector) for receiving the hinge pin 30.

The right side hook 20, similarly, also has a second J-shape 50 that mirrors the first J-shape 40 of the left side hook 15, also for hanging more than one article therefrom. The right side hook 20 has a central eyelet 55 for receiving the hinge pin 30. The central eyelet 55 of the right side hook 20 fits coaxially between the first pair of eyelets 45 of the left side hook 15 and is secured therein by the hinge pin 30 as will be discussed hereinbelow. Each of the first pair of eyelets 45 and the central eyelet 55 has a given diameter D for receiving the hinge pin 30. Other shapes that mirror each other are contemplated herein. Each eyelet defined herein need not extend 360° about the hinge pin but may extend as many degrees as are necessary to secure the eyelet to the hinge pin 30.

The base 25 has a second pair of eyelets 60 extending therefrom to receive the first pair eyelets 45 and the central eyelet 55 therebetween. The base 25 also has a pair of openings 65 through which screws 35 extend to attach the base to a wall or a door or an armoire or the like. Each of the second pair of eyelets also have a diameter D for receiving the hinge pin 30 therethrough except that one of the second pair of eyelets 60 has an interior threaded portion 70.

The hinge pin 30 is cylindrical and has an exterior threaded portion 75 that mates with the interior threaded portion 70 of the second pair of eyelets 60. One of ordinary skill in the art will recognize that the bottom or the top of the second pair of eyelets 60 may have the interior threaded portion 70. However for aesthetic reasons, the bottom of the second pair of eyelets may be threaded so a screw indentation 80 (e.g., as for a flat head or Phillips screw driver) in the hinge pin 30 is not seen from above.

To construct and install the hinge hook 10, the central eyelet 55 of the right hook 20 is placed between the first pair of the eyelets 45 in the left hook 15. The central eyelet 55 of the right hook 20 and the first pair of the eyelets 45 in the left hook 15 are disposed between the second pair of eyelets 60. The hinge pin 30 is extended through all the eyelets and anchored to the bottom of the second pair of eyelets 60 by screwing the exterior threaded portion 75 of the hinge pin 30 into the interior threaded portion of the base 25 to anchor the left side hook 15 and the right side hook 20 into place in the base 25. The hinge pin 10 is assembled and then may be attached to the wall (not shown) or other surface where it may be desired by driving the screws 35 through the openings 65 into the wall (not shown) or the like. While the hinge pin here is shown with symmetrical sides one of ordinary skill will notice that the sides need not be symmetrical or could be of different shapes. The base 25 may be attached to a wall (not shown) or the like before the eyelets are attached thereto.

The right side hook 20 and the left side hook 15 may then rotate about the hinge pin 30 that defines a central axis but each of the left side hook 15 and the right side 20 hook may come into contact with the other of the left side hook 15 and the right side hook 20. Moreover, because the left side hook 15 and the right side hook 20 are mirror images or have portions that are mirror images of each other, if they move together, they may be ganged to hold heavier article if one of the left side hook 15 or the right side hook 20 may not be able support a heavier article or articles.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A hinge hook comprising;

a first hook having a first shape, said first hook rotatable about an axis;

a second hook having a second shape, said second hook rotatable about said axis, wherein upon rotation said first hook and said second hook come into contact with each other, and wherein said first shape and said second shape have portions that are mirror images of each other with each of said first and said second hooks having an upwardly curved distal end; and a base coupled to said first and said second hooks, said base including an attachment interface configured for a fixed attachment to a rigid structure.

2. A hinge hook comprising;

a first hook having a first shape, said first hook rotatable about an axis;

a second hook having a second shape, said second hook rotatable about said axis, wherein said first shape and said second shape are mirror images of each other and wherein upon rotation, said first hook and said second hook come into contact with each other;

a base coupled to said first and said second hooks, said base including an attachment interface configured for a fixed attachment to a rigid structure;

wherein said first hook has a first eyelet extending about said axis and said second hook has a first pair of eyelets extending about said axis with said first eyelet disposed between said first pair of eyelets; and wherein said axis is defined by said base which includes a second pair of eyelets through which said axis extends.

3. The hinge hook of claim 2 wherein said second eyelet comprises a second pair of eyelets and said first eyelet is disposed between said second pair of eyelets.

4. A method for hanging articles comprising:

providing a hinge hook having a pair of hooks mounted coaxially side-by-side and rotatable independently of each other, and wherein providing the hinge hook further comprises providing the pair of hooks with upwardly curved distal ends configured to hold the load;

coupling said pair of hooks to a base configured for a fixed attachment to a rigid structure;

rotating said pair of hooks so that said pair of hooks are in contact side-by-side, and providing a fastener to fix the base to the rigid structure such that the base is not moveable relative to the rigid structure as the hooks are rotated; and hanging a load from both of said hooks.

5. A hinge hook comprising:

a first hook having a first shape, said first hook rotatable about an axis;

a second hook having a second shape, said second hook rotatable about said axis, wherein said first shape and said second shape mirror images of each other and wherein upon rotation said first hook and said second hook come into contact with each other;

wherein said first hook has a single eyelet extending around said axis and said second hook has a first pair of eyelets extending about said axis, and wherein said first hook and said second hook are arranged coaxially, and wherein said single eyelet is disposed between said first pair of eyelets;

a base coupled to said first and said second hooks, said base including a second pair of eyelets that receive said first pair of eyelets and said single eyelet there-between, and wherein said base includes an attachment interface configured for a fixed attachment to a rigid structure;

a hinge pin extending through said single eyelet, said first pair of eyelets, and said second pair of eyelets; and at least one fastener to fix said base to the rigid structure at the attachment interface.

6. A hinge hook comprising:

a first hook having a first shape with an upwardly curved distal end, said first hook rotatable about an axis;

a second hook having a second shape with an upwardly curved distal end, said second hook rotatable about said axis, wherein said first shape and said second shape are mirror images of each other and wherein upon rotation said first hook and said second hook come into contact with each other; and a base coupled to said first and said second hooks, said base including an attachment interface configured for a fixed attachment to a rigid structure, and wherein said axis is defined by said base which has a first pair of eyelets through which said axis extends.

7. A hinge hook comprising:

a first hook having an upwardly curved distal end, said first hook rotatable about an axis;

a second hook having an upwardly curved distal end, said second hook rotatable about said axis; and a base coupled to said first and said second hooks, said base including an attachment interface configured for a fixed attachment to a rigid structure.

8. The hinge hook of claim 7 wherein upon full rotation of said first and said second hooks in a direction toward each other, said first hook and said second hook come into contact with each other.

9. The hinge hook of claim 7 including at least one fastener to fix said base to the rigid structure such that said base is not moveable relative to the rigid structure.

10. The hinge hook of claim 9 wherein the rigid structure comprises one of a wall or door.

11. The hinge hook of claim 7 including a single hinge pin that couples said first hook, said second hook, and said base together such that said first and second hooks are rotatable relative to the rigid structure when the base is fixed to the rigid structure.

12. A hinge hook comprising:

a first hook having a first shape, said first hook rotatable about an axis;

a second hook having a second shape, said second hook rotatable about said axis, wherein said first shape and said second shape are mirror images of each other and wherein upon rotation said first hook and said second hook come into contact with each other, and wherein said first hook has an upwardly curved distal end and said second hook has an upwardly curved distal end; and a base coupled to said first and said second hooks, said base including an attachment interface configured for a fixed attachment to a rigid structure.

13. A hinge hook comprising:

a first hook having a first shape attaching to a connector, said first hook rotatable about an axis;

a second hook having a second shape attaching to a connector, said second hook rotatable about said axis, wherein said first shape and said second shape are mirror images of each other and wherein upon rotation said first hook and said second hook, said first shape and said second shape come entirely into contact with each other, and wherein said first hook has an upwardly curved distal end and said second hook has an upwardly curved distal end;

a base coupled to said first and said second hooks, said base including an attachment interface configured for a fixed attachment to a rigid structure; and at least one fastener to fix said base to the rigid structure such that said base is not moveable relative to the rigid structure.

* * * * *